US006308020B1

(12) United States Patent
Fuke et al.

(10) Patent No.: US 6,308,020 B1
(45) Date of Patent: Oct. 23, 2001

(54) PRINTER AND TRANSFER CHARGER

(75) Inventors: Kenji Fuke; Yoshihiro Tonomoto, both of Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/540,869

(22) Filed: Mar. 31, 2000

(30) Foreign Application Priority Data

Sep. 17, 1999 (JP) ..... 11-264596

(51) Int. Cl.[7] ..... G03G 15/16; G03G 15/20
(52) U.S. Cl. ..... 399/66; 399/311
(58) Field of Search ..... 399/45, 66, 310, 399/311, 314, 315, 316, 317, 384

(56) References Cited

U.S. PATENT DOCUMENTS 5,138,178 8/1992 Wong et al. ..... 399/45 X
5,381,216 1/1995 Osaka et al. ..... 399/315
5,557,389 9/1996 Sato et al. ..... 399/315
5,585,908 12/1996 Rakov et al. ..... 399/311
5,717,981 2/1998 Yamanaka ..... 399/45 X
5,732,315 3/1998 Inoue et al. ..... 399/317
6,070,024 5/2000 Oono ..... 399/66

*Primary Examiner*—Sandra Brase
(74) *Attorney, Agent, or Firm*—Armstrong, Westerman, Hattori, McLeland & Naughton, LLP

(57) ABSTRACT

A printer including a photosensitive drum on which a toner image is formed, a plurality of transfer wires held in facing relation to the drum, and a static-eliminating wire located downstream from the transfer wires. Transfer currents are conducted through a selected one or more of the transfer wires in accordance with the thickness of recording paper used in the printer.

8 Claims, 11 Drawing Sheets

PRINTER AND TRANSFER CHARGER

BACKGROUND OF THE INVENTION

1. Field of the Invention

The present invention relates to an electrophotographic printer for printing images on a recording medium such as paper. The present invention also relates to a transfer charger incorporated in such a printer for transferring images onto a recording medium.

2. Description of the Related Art

Electrophotographic printers have been widely used for printing desired images on a recording medium such as continuous paper, cut sheets and so on. FIG. 11 of the accompanying drawings shows the outline of a conventional electrophotographic printer.

As illustrated, the conventional printer includes a photosensitive drum 90, a latent image forming unit 91, a developing unit 92, a transfer charge unit 93, a fixing unit 95, a pair of tractors 94 (only one shown) and so on. The tractors 94 are provided for feeding continuous recording paper P along a predetermined paper transfer path. For this purpose, though not illustrated, use is made of paper feed rollers to be operated together with the tractors 94.

In the conventional printer, electrostatic latent images are formed on the annular surface 90*a* of the drum 90 by the image forming unit 91. The latent images are developed by the developing unit 92 to produce visible toner images, and then these toner images are transferred onto the paper P by the transfer charge unit 93. Thereafter, the transferred images are fixed to the paper by the fixing unit 95.

The conventional transfer charge unit 93 is provided with only one transfer wire 93*a* and one static-eliminating wire 93*b*. The transfer wire 93*a* allows the passage of electric current (referred to as "transfer current" below) of a predetermined polarity for transferring toner images (formed on the drum 90) onto the paper P. More specifically, the toner images formed on the photosensitive drum 90 are negatively charged, while the transfer wire 93*a* is rendered positive due to the transfer current. Thus, the toner images on the drum 90 will be attracted toward the transfer charge unit 93 to be transferred onto the paper P. In this process, the paper P is positively charged by the transfer current. In this connection, the static-eliminating wire 93*b* serves to eliminate the positive charges on the paper P, thereby preventing the paper P from unduly adhering to the drum 90. Consequently, the paper P is properly fed along the predetermined paper transfer path.

Though having the above advantage, the conventional printer may suffer from the following problems.

As stated above, the annular surface 90*a* of the drum 90 is negatively charged during the printing operation. Thus, when the paper P is brought to the drum 90, part of the paper P will adhere to the annular surface 90*a* of the drum 90. Specifically, as shown in FIGS. 12 and 13, the adhering amount or manner of the paper P varies depending on the thickness (stiffness) of the paper P. For instance, when the paper P (p') is relatively thin (FIG. 12), a larger area of the paper P' is stuck to the drum 90, and the sticking begins at a position N1. On the other hand, when the paper P (p") is relatively thick (FIG. 13), only a smaller area of the paper p" is stuck to the drum 90, and the sticking begins at a position N2, which is located downstream of the paper transfer path from the above-mentioned position N1.

Keeping the above-described behavior of the paper P in mind, attention is drawn to the transfer charge unit 93 of the conventional printer. As stated above, the conventional transfer charge unit 93 is provided with only a single transfer wire 93*a* fixed at a position facing the photosensitive drum 90. Even with such an arrangement, it may be possible to perform proper image transfer onto the comparatively thin paper p' shown in FIG. 12, wherein the transfer wire 93*a* is located immediately downstream from the position N1.

However, when the comparatively thick paper P" is used (FIG. 13), the transfer wire 93*a* is located upstream from the position N2, which means that the transfer wire 93*a* faces a portion of the paper p" which has still not come into engagement with the annular surface 90*a* of the drum 90. In this state, disadvantageously, the toner images on the drum 90 may fail to be properly transferred onto the paper P", so that no good printing results are obtainable.

Further, in the conventional printer, the range over which the transfer current is effective for drawing the toner images toward the recording paper is not variable depending on e.g. the type of paper P. Also, the strength of the transfer current may not be readily adjusted. Clearly, these inconveniences tend to be obstacles to proper transfer of toner images onto the recording paper.

SUMMARY OF THE INVENTION

The present invention has been proposed under these circumstances, and its object is to make it possible to perform proper toner image transfer from a photosensitive member to a recording medium, regardless of the type or other properties of the recording medium.

According to a first aspect of the present invention, there is provided a printer comprising:

a photosensitive member on which a toner image is formed;

image transfer means held in facing relation to the photosensitive member and arranged to conduct a transfer current for transferring the toner image onto a recording medium; and at least one static-eliminating wire for conducting a discharge current for discharging the recording medium;

wherein the image transfer means is provided with a plurality of transfer wires spaced from each other in a feeding direction of the recording medium, the transfer current being selectively conducted through the transfer wires.

The photosensitive member may be a photosensitive drum or belt-like member.

With the above arrangement, it is possible to pass transfer currents through a selected one (or ones) of the transfer wires. In this manner, the locations at which the transfer currents are caused to flow can be altered. Therefore, by changing the above-mentioned locations, the transferring of toner images onto the recording medium is properly performed in accordance with e.g. the thickness of the recording medium. Further, since the number of live transfer wires is variable according to the above arrangement, it is possible to adjust (increase or reduce) the area of the recording medium over which the transfer currents have an effect. It is also possible to adjust the amount of charge to be supplied to the recording medium.

According to a preferred embodiment, the transfer current and the discharge current may be variable.

Preferably, the printer of the present invention may further comprise a common casing for fixing the transfer wires and the static-eliminating wire.

With such an arrangement, the transfer wires and the static-eliminating wire may be collectively handled, which is advantageous in setting these wires in facing relation to the photosensitive member.

According to a second aspect of the present invention, there is provided a printer comprising:

a photosensitive member on which a toner image is formed;

image transfer means held in facing relation to the photosensitive member and arranged to conduct a transfer current for transferring the toner image onto a recording medium;

at least one static-eliminating wire for conducting a discharge current for discharging the recording medium;

a power circuit for supplying the transfer current to the image transfer means;

controlling means for causing the power circuit to selectively supply the transfer current to the image transfect means; and operation means arranged to be operated in a first manner when a thickness of the recording medium is no greater than a predetermined value, while being operated in a second manner when said thickness is greater than the predetermined value;

wherein the image transfer means is provided with a plurality of transfer wires spaced in a feeding direction of the recording medium, the transfer current being supplied at least to selected one of the transfer wires when the operation means is operated in said first manner, the transfer current being supplied at least to another one of the transfer wires when the operation means is operated in said second manner, said another one of the transfer wires being located downstream in the feeding direction from said selected one of the transfer wires.

According to a third aspect of the present invention, there is provided a printer comprising:

a feeding path along which elongated recording medium is fed;

a photosensitive member on which a toner image is formed;

image transfer means held in facing relation to the photosensitive member and arranged to conduct a transfer current for transferring the toner image onto the recording medium;

at least one static-eliminating wire for conducting a discharge current for discharging the recording medium; and controlling means for adjusting the transfer current and the discharge current;

wherein the image transfer means is provided with a plurality of transfer wires spaced along the feeding path, the transfer current being selectively conducted through the transfer wires; and wherein the transfer current and the discharge current are rendered greater for performing automatic-loading of the recording medium than for performing printing on the recording medium.

Preferably, the transfer wires may be moved farther away from the photosensitive member for performing the automatic-loading of the recording medium than for performing the printing on the recording medium.

Such an arrangement is advantageous for performing automatic-loading of the recording medium.

According to a fourth aspect of the present invention, there is provided a transfer charger comprising:

a transfer current conductor held in facing relation to a photosensitive member of a printer; and at least one static-eliminating wire for conducting a discharge current;

wherein the transfer current conductor is provided with a plurality of transfer wires arranged in parallel, the transfer wires selectively conducting a transfer current.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
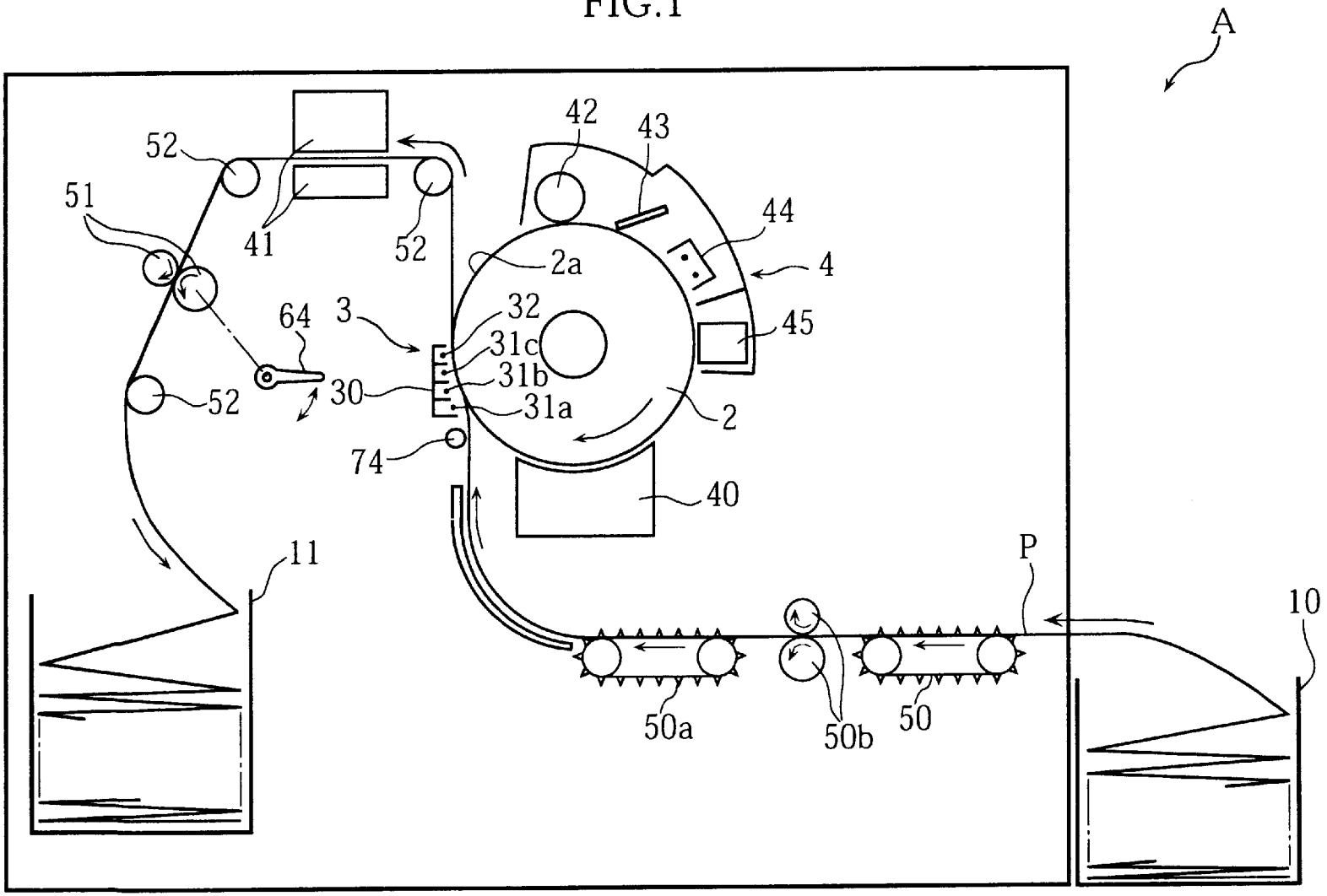
FIG. 1 illustrates the outline of a printer according to a first embodiment of the present invention.

FIG. 1 shows a printer A according to a first embodiment of the present invention. The illustrated printer A is arranged to perform printing on only one side (e.g. obverse side) of elongated continuous paper P. For this purpose, the printer A is provided with a paper holder 10, a photosensitive drum 2, a latent image forming unit 4, a developing unit 40, a transfer charger 3, a fixing unit 41, a paper stacker 11, and other components described hereinafter.

One of the most important features of the printer A resides in the arrangement of the transfer charge unit 3, while other components of the printer A are basically similar in arrangement to those of a printer disclosed in Japanese patent application No. 11-33124 of Applicant. The disclosure of this Japanese patent application is incorporated herein by reference to the document.

Specifically, the paper holder 10 is arranged to accommodate the paper P in an alternately folded manner. Though not illustrated, the paper P is formed with two columns of multiple indexing holes extending along the longitudinal edges (marginal edges) of the paper P, respectively. The indexing holes in the respective columns are disposed at regular intervals to come into engagement with tractor pins protruding outward from tractor belts of tractors 50, 50*a*.

Further, the paper P is provided with multiple perforation lines (not shown) each of which extends widthwise of the paper P. These perforation lines are spaced from each other longitudinally of the paper P by a predetermined distance. With such an arrangement, after a printing operation is over, the continuous paper P may be manually separated at the perforation lines into individual sheets of paper.

After being paid out from the paper holder 10, the paper P is fed forward by the tractors 50, 50*a* and a pair of rotatable feed rollers 50*b* to be introduced into the nip between the drum 2 and the transfer charge unit 3. In general, elongated continuous papers may be classified by thickness, width and so forth. In this specification, recording paper is described as "thick" when its ream weight is no less than 90 kg, while being described as "thin" when its ream weight is about 55 kg.

The photosensitive drum 2, which is rotatable about a horizontal axis, has an annular surface 2*a* on which electrostatic latent images are formed by the image forming unit 4. The image forming unit 4 includes a cleaning brush 42 and a cleaning blade 43 for cleaning the annular surface 2*a* of the drum 2.

Further, the image forming unit 4 includes an electric charger 44 and LED illuminator 45. The electric charger 44 is provided for uniformly charging the annular surface 2*a* of the drum 2. The thus charged surface 2*a* is irradiated with light from the LED illuminator 45 in accordance with printing data, so that electrostatic latent images are formed on the drum 2. The above latent images are developed by the developing unit 40 to produce visible toner images having a negative electric potential.

After passing the drum 2 and the transfer charge unit 3, the paper P is moved toward the stacker 11 by a pair of scuff rollers 51 and a plurality of paper transfer rollers 52. For this purpose, the scuff rollers 51 and the paper transfer rollers 52 are disposed downstream of the paper transfer path from the photosensitive drum 2. The circumferential speed of the scuff rollers 51 is rendered greater than the speed of the tractor belt of the tractor 50*a*. Thus, the paper P is properly tensioned between the tractor 50*a* and the scuff rollers 51 so as not to unduly sag. In this connection, it should be noted that the scuff rollers 51 are held in selectively slidable contact with the paper P. Thus, the paper P is prevented from being torn at the indexing holes by the tractor pins of the tractors 50*a*. For the fixing unit 41, use is made of a flash lamp for enabling high-speed printing. After passing the fixing unit 41, the paper P is alternately folded, as shown in FIG. 1, to be accommodated in the stacker 11.

Figure 2:
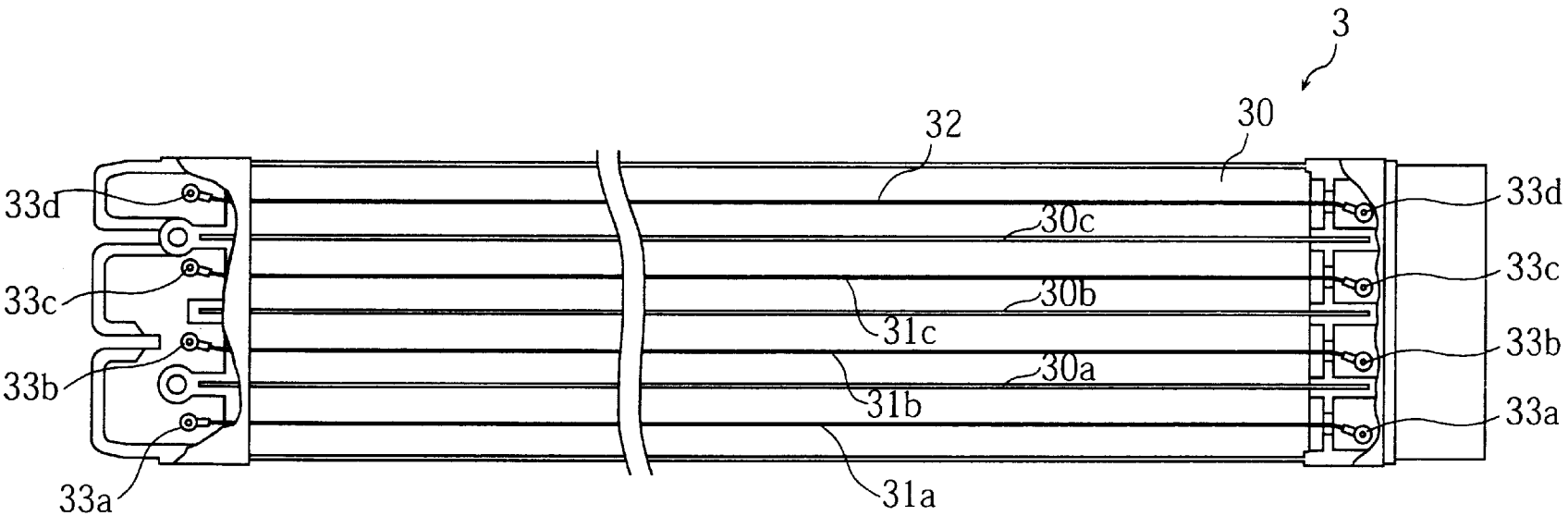
FIG. 2 is a plan view showing a transfer charge unit incorporated in the printer of FIG. 1.

As shown in FIG. 2, the transfer charge unit 3 is provided with a casing 30, three transfer wires 31*a*–31*c*, and one static-eliminating wire 32. The casing 30 has an elongated, box-like configuration open to the exterior at one side. The transfer wires 31*a*–31*c* and the static-eliminating wire 32 are conductive metal wires spaced from each other widthwise (vertically, in FIG. 2) of the casing 30. Each wire extends longitudinally of the casing 30 to be fixed at its both ends to the casing 30. Advantageously, such an arrangement (i.e., the wires 31*a*–31*c* and 32 are all arranged within the single casing 30) makes it possible to handle the four wires collectively.

As shown in FIGS. 1 and 2, the above four wires 3l*a*–31*c* and 32 are separated from each other by partitions 30*a*–30*c* fixed to the casing 30. Of the three partitions, the partition 30*c* (arranged between the static-eliminating wire 32 and the transfer wire 31*c*) is electrically insulated so that no electric discharge will occur between the static eliminating wire 32 and the transfer wires 31*a*–31*c*. At their both ends, the wires 31*a*–31*c* and 32 are connected to terminals 33*a*–33*d*, respectively. As will be described later, each of the transfer wires 31*a*–31*c* is arranged to selectively pass a transfer current, while the static-eliminating wire 32 is arranged to selectively pass a discharge current.

As shown in FIG. 1, the transfer charger unit 3 is arranged in facing relation to the annular surface 2*a* of the photosensitive drum 2, with the wires 31*a*–31*c* and 32 extending in the axial direction of the drum 2. As viewed along the paper transfer path, the transfer wire 31*a* comes first of the four wires, and then the other wires 31*b*, 31*c*, and 32 are disposed, in this order, downstream of the paper transfer path.

Figure 4:
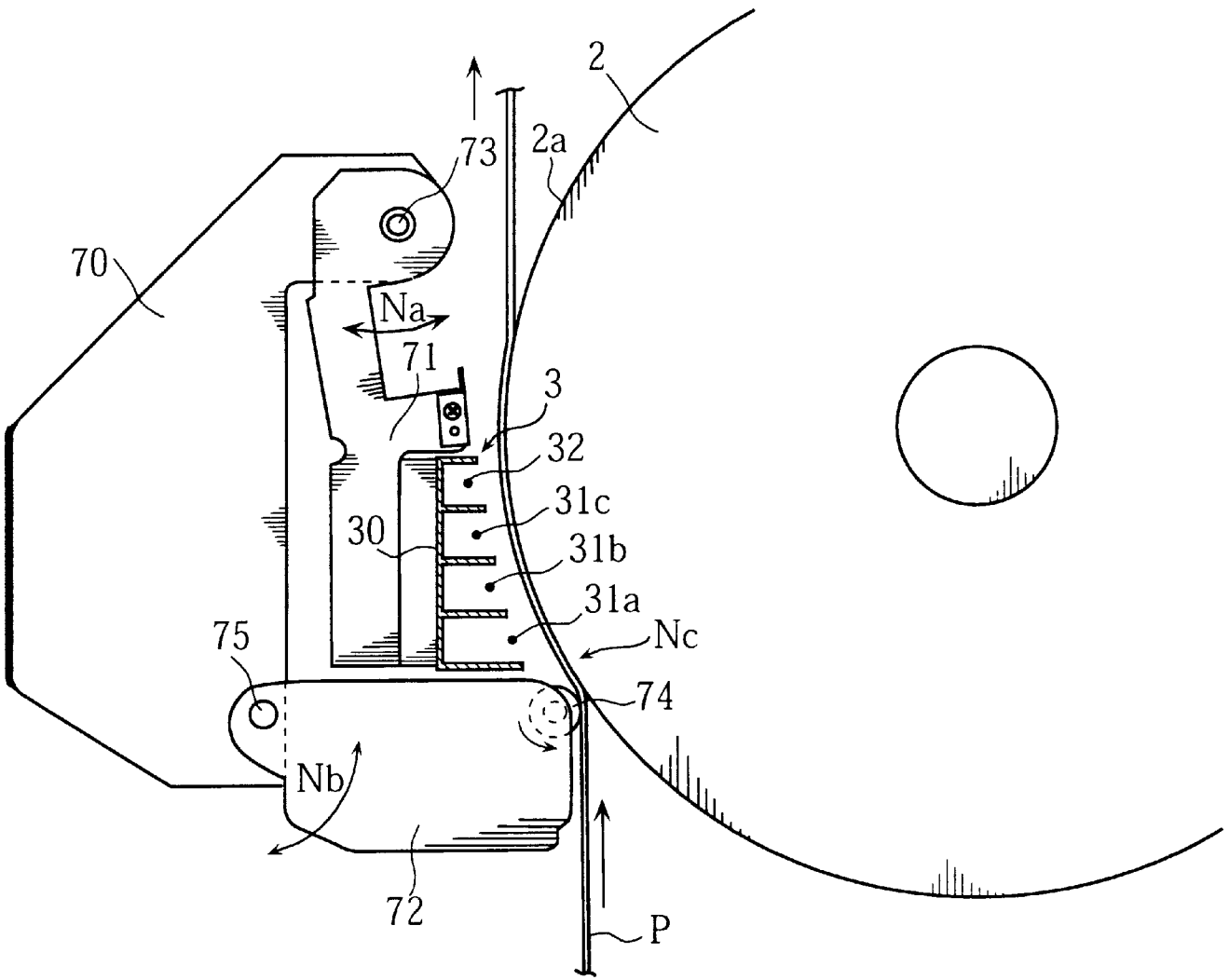
FIG. 4 is a side view showing how printing is performed on thin recording paper.

As shown in FIG. 4, the transfer charge unit 3 is mounted on a first bracket 71. The first bracket 71 has an upper portion fixed to a shaft 73 which is pivotably supported by a base bracket 70. Though not shown, the shaft 73 is connected to a reversible motor. Thus, upon actuation of the motor, the first bracket 71 is caused to pivot toward or away from the drum 2, as shown by a two-headed arrow Na. In this manner, the transfer charge unit 3 is movable between a set position closer to the drum 2 and a release position farther from the drum 2. In the set position, the four wires 31*a*–31*c* and 32 are spaced from the annular surface 2*a* by a comparatively short distance (e.g. about 8.3 mm), while in the release position, the distance may be about 14.1 mm.

As also shown in FIG. 4, a guide roller 74 supported by a second bracket 72 is provided at a position upstream of the paper transfer path from the transfer charge unit 3. The second bracket 72 is pivotable relative to the base bracket 70 about a shaft 75, as shown by a two-headed arrow Nb. Though not shown, the pivoting of the second bracket is also caused by a motor connected to the shaft 75. The guide roller 74 is rotated in a manner such that the circumferential speed of the roller 74 is equal to the feeding speed of the paper P. By adjusting the position of the second bracket 72 relative to the drum 2, the guide roller 74 causes the paper P to be properly held in contact with the annular surface 2*a* of the drum 2.

In this way, the guide roller 74 serves to define (part of) the paper transfer path. The base bracket 70 is manually adjustable in position and can be brought away from the photosensitive drum 2 by an appropriate distance. With such an arrangement, the paper P will be easily removed even if it is jammed between the photosensitive drum 2 and the transfer charge unit 3.

Figure 3:
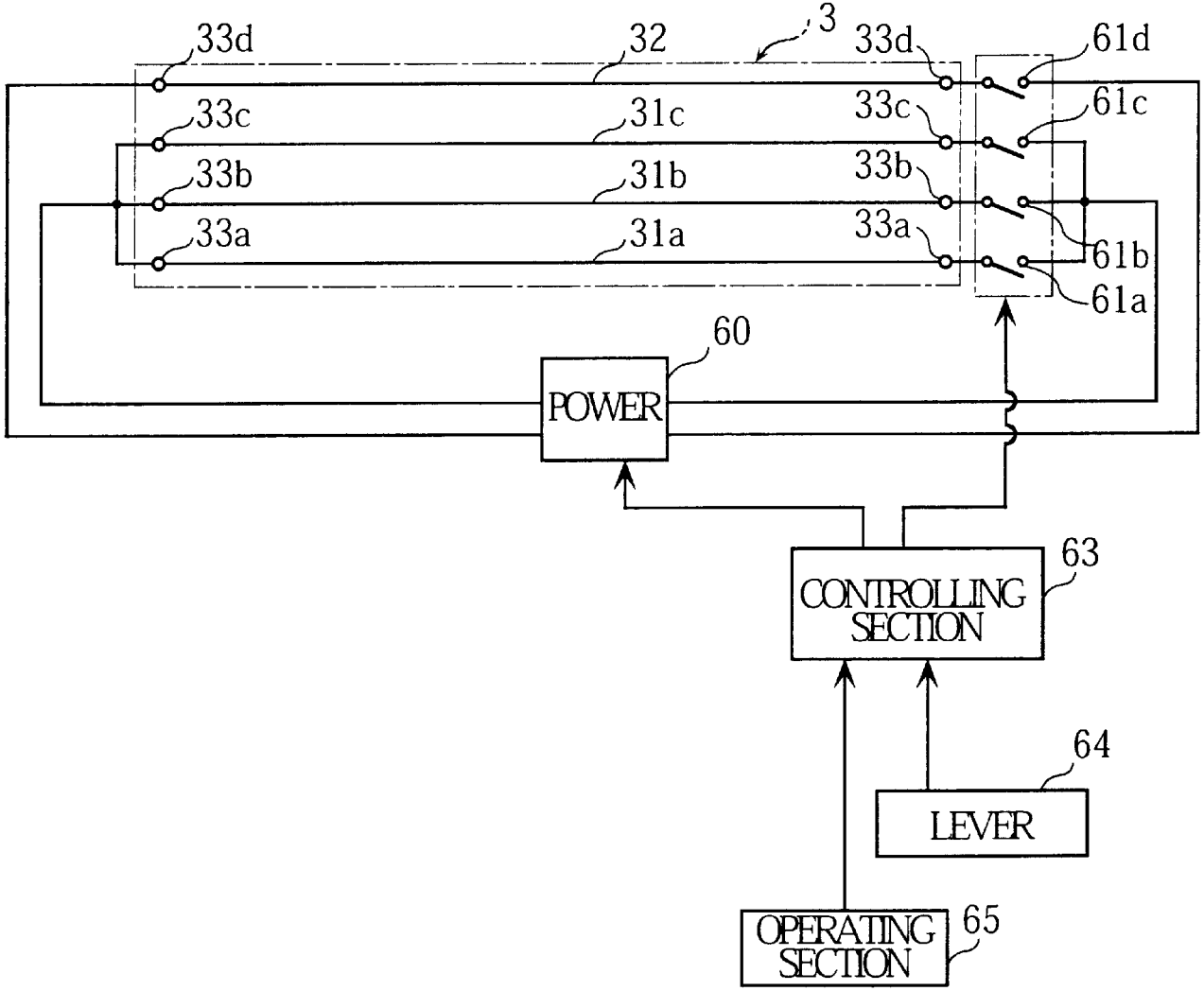
FIG. 3 illustrates the outline of a control system for driving the transfer charge unit.

Referring now to FIG. 3, a control system for driving the transfer charge unit 3 will be described. As illustrated, the control system for the charge unit 3 includes a power circuit 60, a plurality of switches 61*a*–61*d* and a control section 63.

The power circuit 60 is provided for causing transfer currents to pass through the wires 31*a*–31*c* and for causing a discharge current to pass through the wire 32. The three transfer wires 31*a*–31*c* are connected in parallel to the power circuit 60 via switches 61*a*–61*c*, respectively. By operating these switches 61*a*–61*c*, a predetermined voltage is selectively applied across the transfer wires 31*a*–31*c*, thereby generating the above-mentioned transfer current.

Separately of the transfer wires 31*a*–31*c*, the static-eliminating wire 32 is also connected to the power circuit 60 via a switch 61*d*. By operating this switch 61*d*, a predetermined voltage is selectively applied across the static-eliminating wire 32, thereby causing the discharge current to pass through the wire 32. Typically, the discharge current is made up of a combination of a direct current and an alternating current. It should be appreciated that the power circuit 60 has a voltage-transforming function, so that the voltages applied to the terminals 33*a*–33*d* can be varied under the control of the control section 63. Consequently, the transfer current and the discharge current are rendered variable.

The switches 61*a*–61*d* can be turned on and off, independently of each other, under the control of the control section 63. For this purpose, the control section 63 may include a CPU arranged to cooperate with memories. As shown in FIG. 3, the control section 63 is associated with an operation lever 64 and with operation switches (not shown) in an operating section 65. Thus, by handling the operation lever 64 and/or non-illustrated operation switches, it is possible to turn on and off the switches 61*a*–61*d* selectively, and also to adjust (increase or decrease) the output voltages of the power circuit 60.

As shown in FIG. 1, the operation lever 64 is also associated with the scuff rollers 51 in a manner such that the distance between the scuff rollers 51 can be altered upon operation of the lever 64. For this purpose, the lever 64 may be pivotable between two extreme positions (or first and second positions). When the lever 64 is brought to the first position, the distance between the scuff rollers 51 may be decreased to a predetermined minimum value. On the other hand, when the lever 64 is brought to the second position, the distance may be increased to a predetermined maximum value.

With such an arrangement, the paper P, whether thin or thick, can be pinched properly by the scuff rollers 51 with substantially the same pressure. As will be described in detail later, the control section 63 (FIG. 3) functions differently depending on whether the operation lever 64 is at the first position or at the second position. Though not shown in FIG. 3, the control section 63 is also associated with the transfer charge unit 3 and the guide roller 74. Thug, the positions of the unit 3 and the roller 74 are adjusted under the control of the control section 63, as will be described later.

Figure 6:
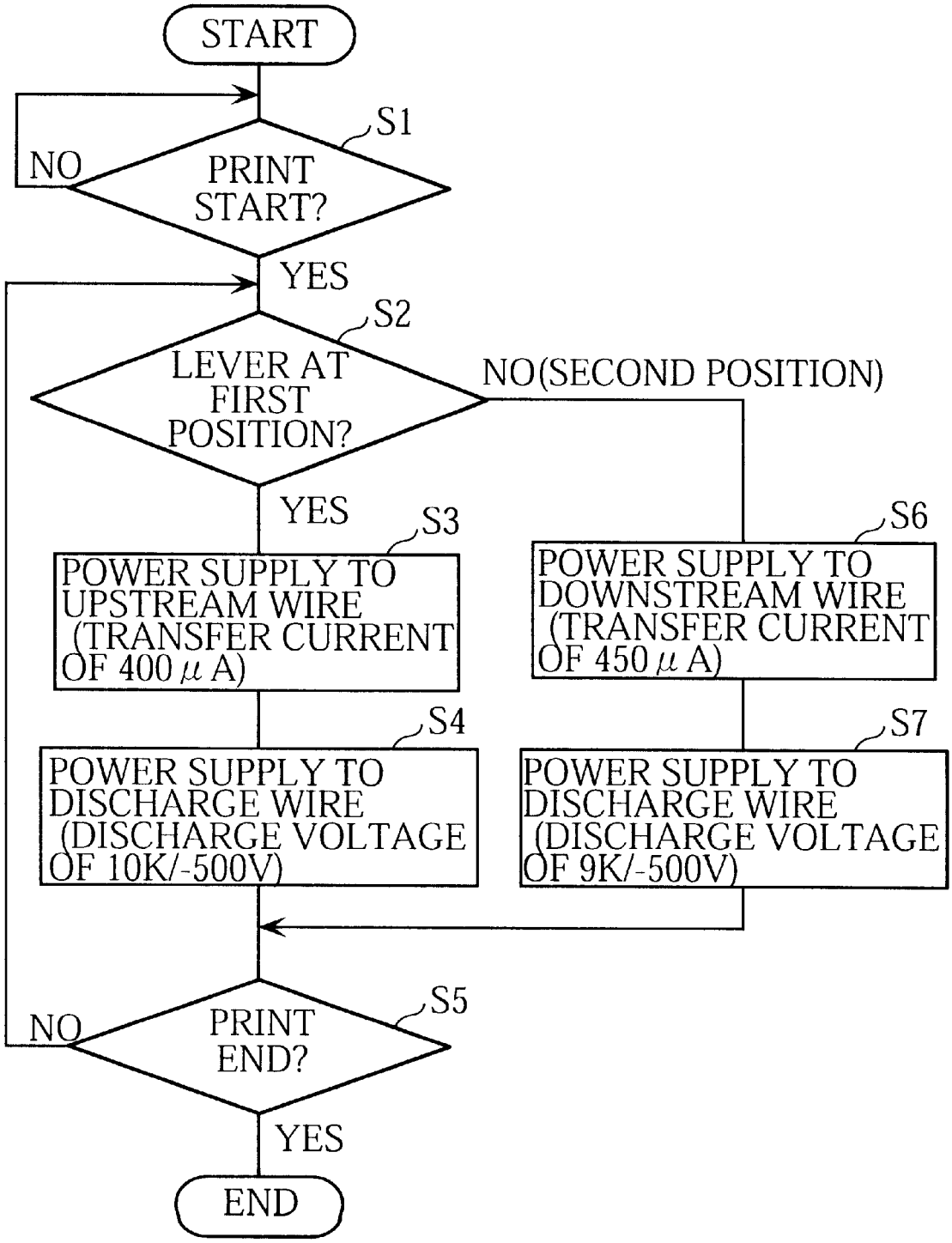
FIG. 6 is a flow chart showing how a controller operates.

Referring now to FIG. 6 (and other figures when appropriate), the operation of the printer A will be described below.

To start printing (S1:YES), the operation lever 64 is manually brought to the first position (S2:YES) when the paper P is thin. Then, the control section 63 (FIG. 3) causes the switches 61*a* and 61*b* to be turned on, while keeping the third switch 61*c* turned off. In this way, transfer currents will flow through only the two transfer wires 31*a* and 31*b*, which are arranged upstream of the third transfer wire 31*c* (S3). Further, the control section 63 causes the fourth switch 61*d* to be turned on, so that discharge current will flow through the static-eliminating wire 32 (S4). In the preferred embodiment, the transfer current may be 400 $\mu$A, while the voltage applied across the static-eliminating wire 32 may be a direct voltage of −500V superposed on an alternating voltage of 10 kV (a combination of the direct voltage and the alternating voltage).

When the paper P is thin (hence highly flexible), a comparatively large area of the paper P tends to adhere to the annular surface 2*a* of the drum 2, as shown in FIG. 4. Thus, immediately after passing the guide roller 74, the paper P is stuck to the annular surface 2*a* at a location shown by an arrow Nc. In this state, as described above, transfer currents are caused to flow through the first and second transfer wires 31*a*–31*b*, which are closer to the above-mentioned location Nc than the third transfer wire 31*c* is. In this manner, a toner image formed on the drum 2 is properly transferred onto the paper P as soon as (or immediately after) the toner image touches the paper P.

After the transfer of the toner image is completed, the paper P passes by the static-eliminating wire 32, so that residual charges on the paper P will be removed. Thereafter, the paper P is moved further along the paper transfer path. When the current printing operation comes to an end (S5:YES in FIG. 6), the control section 63 terminates the power supply to the transfer wires 31*a*, 31*b* and the static-eliminating wire 32.

When the paper P to be used is thick, as opposed to the above instance, the operation lever 64 is set in the second position (S2:NO in FIG. 6). Then, under the control of the control section 63, the switches 61*a*–61*c* (FIG. 3) are operated so that transfer currents will flow through only the second and third transfer wires 31*b* and 31*c* (S6 in FIG. 6), which are arranged downstream from the first transfer wire 31*a*. At the same time, the control section 63 causes the fourth switch 61*d*to be turned on, whereby a discharge current will flow through the static-eliminating wire 32 (S7).

In the above case (where thick paper P is used), the transfer current to be supplied by the power circuit 60 may be 450 $\mu$A. It should be noted here that this transfer current is greater than the above-discussed transfer current (400 $\mu$A) used for thin paper P. However, the voltage to be applied across the static-eliminating wire 32 is rendered lower than the previous one. Specifically, the static-eliminating voltage used for the thick paper P may a direct voltage of −500V superposed on an alternating voltage of 9kV.

Figure 5:
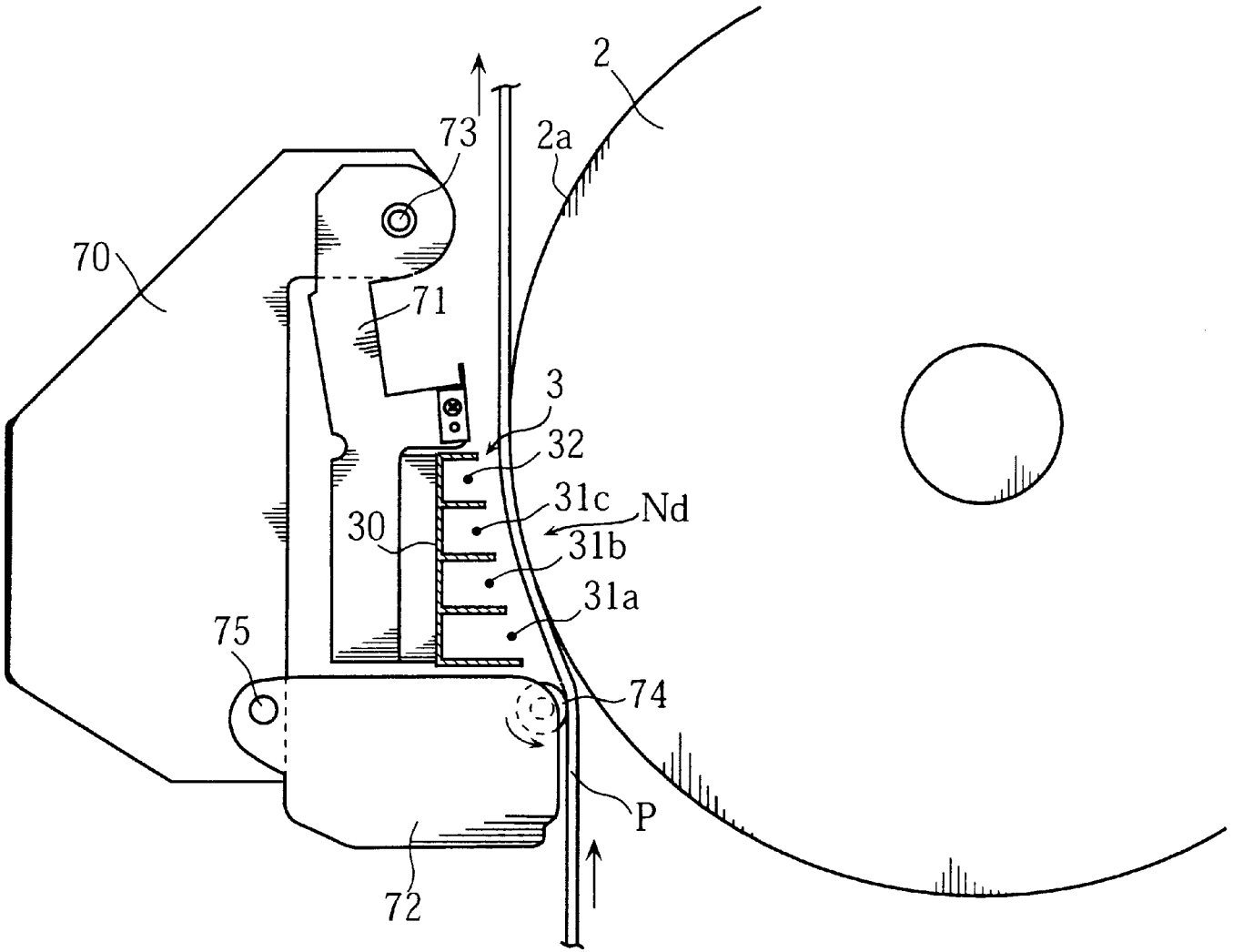
FIG. 5 is a side view showing how printing is performed on thick recording paper.

Referring to FIG. 5, when the paper P is relatively thick (hence less flexible), only a smaller area of the paper P tends to adhere to the drum surface 2*a*. Consequently, the initial contact of the thick paper P with the surface 2*a* will occur at a location Nd which is downstream from the location Nc shown in FIG. 4. In use of the thick paper P, as previously stated, the transfer currents are caused to flow through the second and third transfer wires 31*b*, 31*c*, which are adjacent to the location Nd. Thus, in this case again, the toner image transfer from the drum 2 to the paper P is properly performed as soon as (or immediately after) the toner image touches the paper P.

In general, thick paper is electrically less chargeable than thin paper. In addition, the distance between the drum 2 and the transfer charge unit 3 needs to be made greater as the thickness of the paper increases, which may render the charging of the paper more difficult.

According to the illustrated embodiment of the present invention, however, when printing is to be performed on relatively thick paper P, an accordingly greater transfer current is used. In this manner, proper toner image transfer will be performed even with the thick paper P. Contrarily, as the thickness of paper increases, removal of static electricity from the paper becomes easier. Thus, discharge current used for thick paper may be smaller than one used for thin paper.

According to the present invention, it is possible to bend the thick paper P to a greater extent than is illustrated in FIG. 5. In such an instance, the paper P may be brought into first contact with the annular surface 2*a* at the location Nc of FIG. 4. To achieve such bending, use may be made of mechanical guiding means such as an additional guide roller. However, when the thick paper P is bent too much, it may fail to restore to the original planar form after the paper P is detached from the drum 2. In such an instance, the paper P may unduly thrash after the toner image is transferred onto the paper P. Thus, preferably the thick paper P needs to be fed along a substantially straight path, as shown in FIG. 5, between the drum 2 and the transfer charge unit 3.

As described above, the toner image formed on the drum 2 is properly transferred onto the paper P, regardless of the thickness of the paper P. Thus, high-quality printing is carried out in the printer A of the present invention. Further, the selection of which transfer wires to be used of the three wires 31*a*–31*c* is automatically made by the control section 63 with reference to the position of the operation lever 64 (i.e., depending on whether the lever 64 is at the first position or second position). With such an arrangement, the user of the printer A is advantageously free from the burden of selecting suitable ones among the three transfer wires 3l*a*–31*c*.

Still further, as will be described below, the printer A of the first embodiment is also advantageous in automatically loading the paper P into the paper transfer path. The paper loading may be performed as follows.

First, the user operates predetermined switches in the operating section 65 for causing the control section 63 to turn on all of the first to fourth switches 61*a*–61*d* (FIG. 3). As a result, the power circuit 60, being controlled by the control section 63, supplies a predetermined transfer current to the transfer wires 31*a*–31*c* and a predetermined discharge current to the static-eliminating wire 32. At this time, the transfer current may be 500 $\mu$A, which is greater than the above-mentioned transfer currents used for performing printing on thick or thin paper P. The voltage applied across the fourth wire 32 for producing the discharge current may be a direct voltage of −500V superposed on an alternating voltage of 11kv, which is higher than the voltage used for performing the printing described above.

In the above conditions, when the paper P is brought to the nip between the drum 2 and the transfer charge unit 3 from the holder 10 by the tractors 50, 50*a* and the rollers 51, the paper P will be charged more strongly and in a broader area than is required in performing printing. Therefore, the paper P is caused to adhere to the drum 2 more firmly, so that the rotating drum 2 can reliably send the paper P downstream of the paper transfer path In this manner, it is possible to properly perform the automatic loading of the paper P. In this connection, it should be noted that the discharge current flowing through the wire 32 is rendered greater for properly discharging the paper P.

For facilitating the automatic loading operation, the transfer charge unit 3 is arranged to selectively take the set position (close to the annular surface 2*a* of the drum 2) and the release position (spaced away from the surface 2*a*) under the control of the control section 63. With such an arrangement, the transfer charge unit 3 is initially (i.e., at the beginning of the automatic loading) disposed in the release position. Then, after the leading (front) end of the paper P is nipped between the transfer charge unit 3 and the drum 2, the charge unit 3 is brought to the set position under the control of the control section 63. In this manner, the leading end of the paper P being transferred is prevented from interfering with the charge unit 3, so that the automatic loading of the paper P is carried out reliably.

Reference is now made to FIGS. 7 to 10 illustrating variations of the present invention. Throughout these figures, the same reference numbers or characters are used for referring to elements identical or similar to those of the first embodiment described above.

Figure 7:
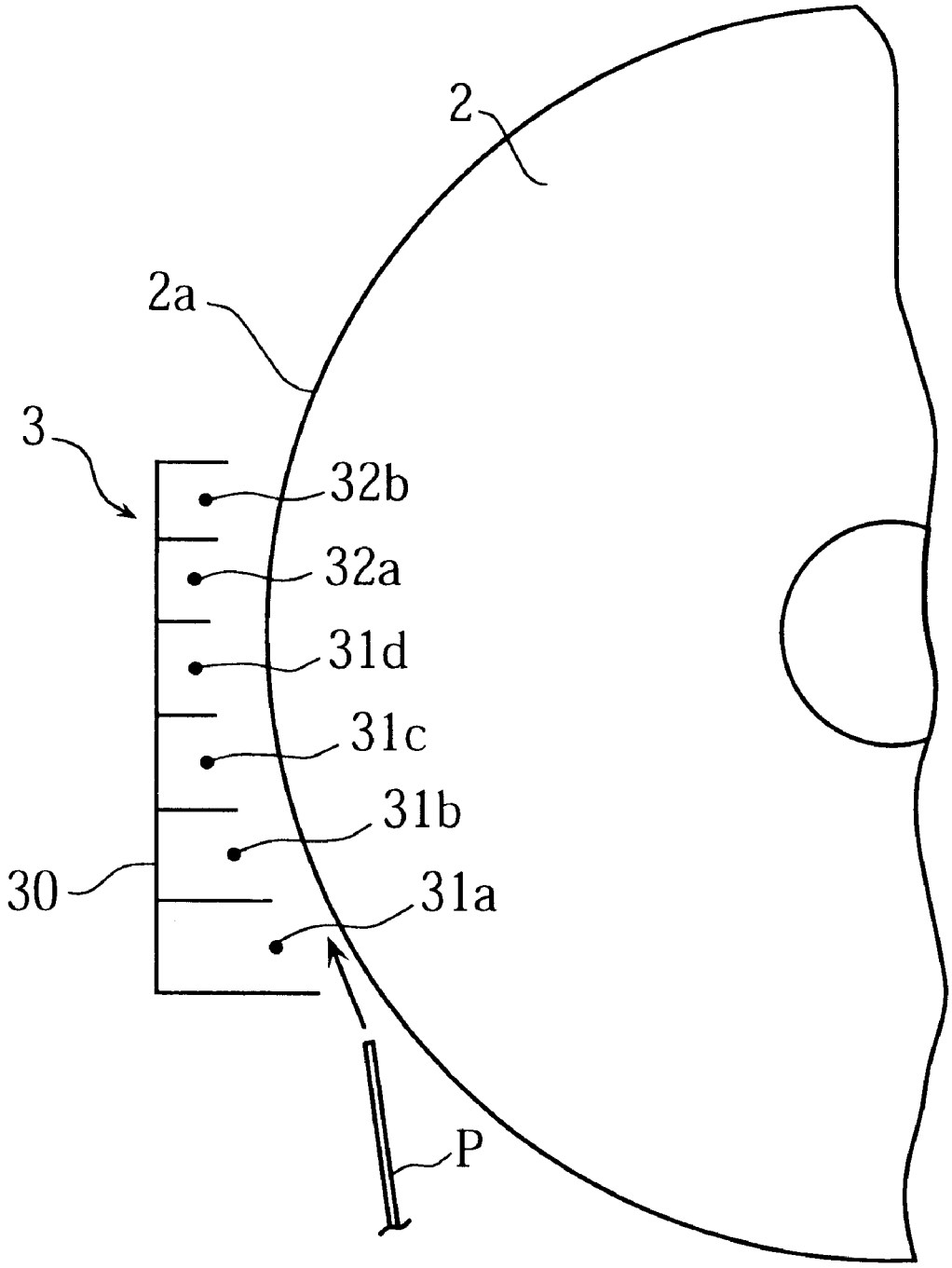
FIG. 7 is a side view showing principal portions of another type of transfer charge unit.

According to the arrangement shown in FIG. 7, a transfer charge unit 3 is provided with four transfer wires 31*a*–31*d* and two static-eliminating wires 32*a*, 32*b*. Each of the four wires 31*a*–31*d* allows the passage of a transfer current, independently of the other transfer wires. Similarly, each of the two wires 32*a*–32*b* allows the passage of a discharge current, independently of the other static-eliminating wire.

With such an arrangement, when transfer currents are applied to the first and second transfer wires 31*a*–31*b* (for printing on relatively thin paper P), discharge current may be applied only to the first static-eliminating wire 32*a*. On the other hand, when transfer currents are applied to the third and fourth transfer wires 31*c*–31*d* (for printing on relatively thick paper P), discharge current may be applied only to the second static-eliminating wire 32*b*.

In this manner, a live transfer wire and a live static-eliminating wire are spaced from each other by an appropriate distance. If these two live wires were unduly be close to each other, a toner image on the drum 2 would fail to be properly transferred onto the paper P due to the opposing polarities of the transfer and discharge currents. According to the arrangement shown in FIG. 7, however, it is possible to to maintain a suitable distance between transfer current and discharge current. Thus, toner image transfer and the discharging of paper P can be properly performed, regardless of whether the paper P is thick or thin.

In the above embodiment, use is made of four transfer wires and two static-eliminating wires. However, the present invention is not limited to this, and the two kinds of wires may be varied in number.

Further, according to the present invention, it is possible to selectively apply either transfer current or static-transfer current to one (or more) of the four transfer wires 31*a*–31*d*. With such an arrangement, it is possible to alter the location for discharging the paper P and vary the area of a discharged portion of the paper P, without changing the number of the originally provided static-eliminating wires 32*a*–32*b*. Likewise, it is also possible to selectively apply either transfer current or static-transfer current to at least 20 one of the two static-eliminating wires 32*a*–32*b*.

Figure 8:
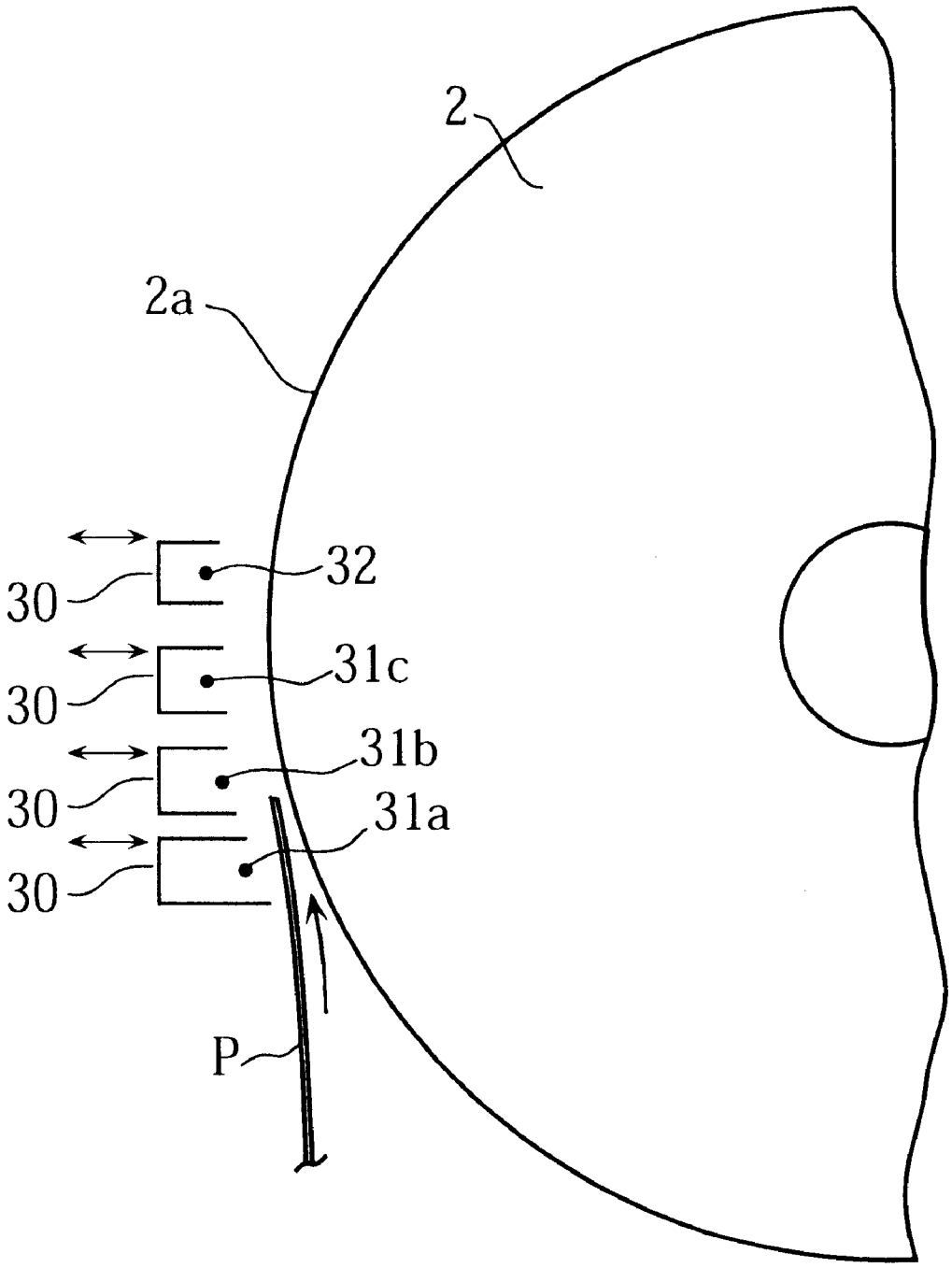
FIG. 8 is a side view showing principal portions of another type of transfer charge unit.

FIG. 8 shows another example according to the present invention. Specifically, four separate casings 30 are provided for accommodating three transfer wires 31*a*–31*c* and one static-eliminating wire 32, respectively. These casings 30 are movable, independently of each other, toward and away from the annular surface 2*a* of a photosensitive drum 2. With such an arrangement, each of the wires 31*a*–31*c* and 32 can be arranged at a suitable position relative to the drum 2 or paper P so that toner image transfer and discharging of the paper P are properly performed.

Figure 9:
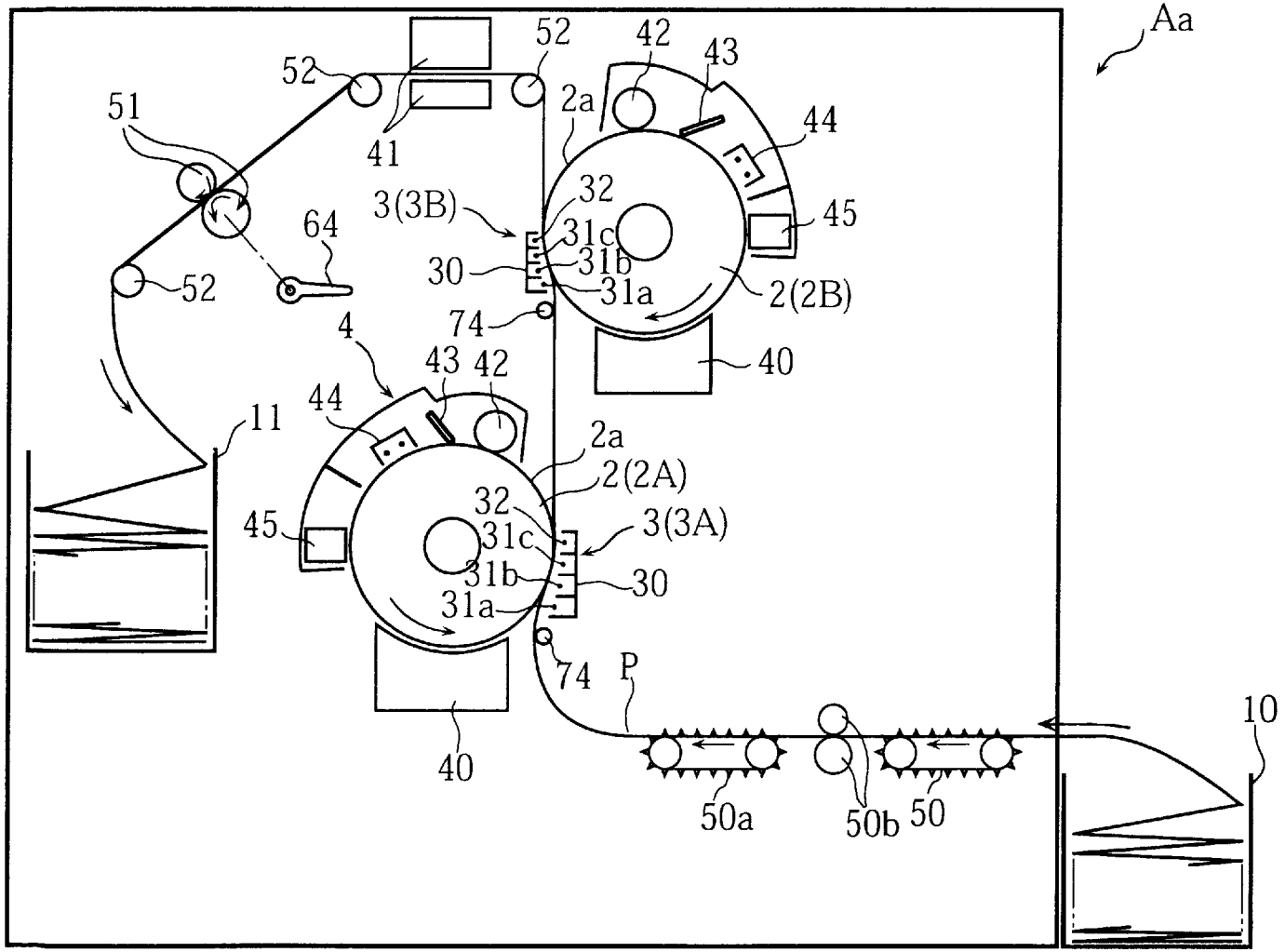
FIG. 9 is a side view showing the outline of a printer according to a second embodiment of the present invention.

FIG. 9 shows a printer Aa according to a second embodiment of the present invention. As illustrated, the printer Aa is provided with two photosensitive drums 2 (and two sets of similar or identical components, with each set associating with one of the drums 2). With such an arrangement, the printer Aa is capable of performing printing on both sides of the paper P (namely, the printer Aa is a "perfecting printer").

More specifically, the first drum 2(2A) is arranged to perform printing on the obverse side of the paper P, while the second drum 2(2B) is arranged to perform printing on the reverse side of the paper P. The toner images transferred onto the paper P from the two drums 2A, 2B are fixed by a fixing unit 41 arranged downstream from the second drum 2B. Two transfer charge units 3(3A, 3B) are held in facing relation to the first and second photosensitive drums 2A–2B, respectively. Each of the charge units 3A and 3B is similar in arrangement to the transfer charge unit 3 of the first embodiment (see FIG. 1). As seen from this example, the present invention is also applicable to a perfecting printer.

Figure 10:
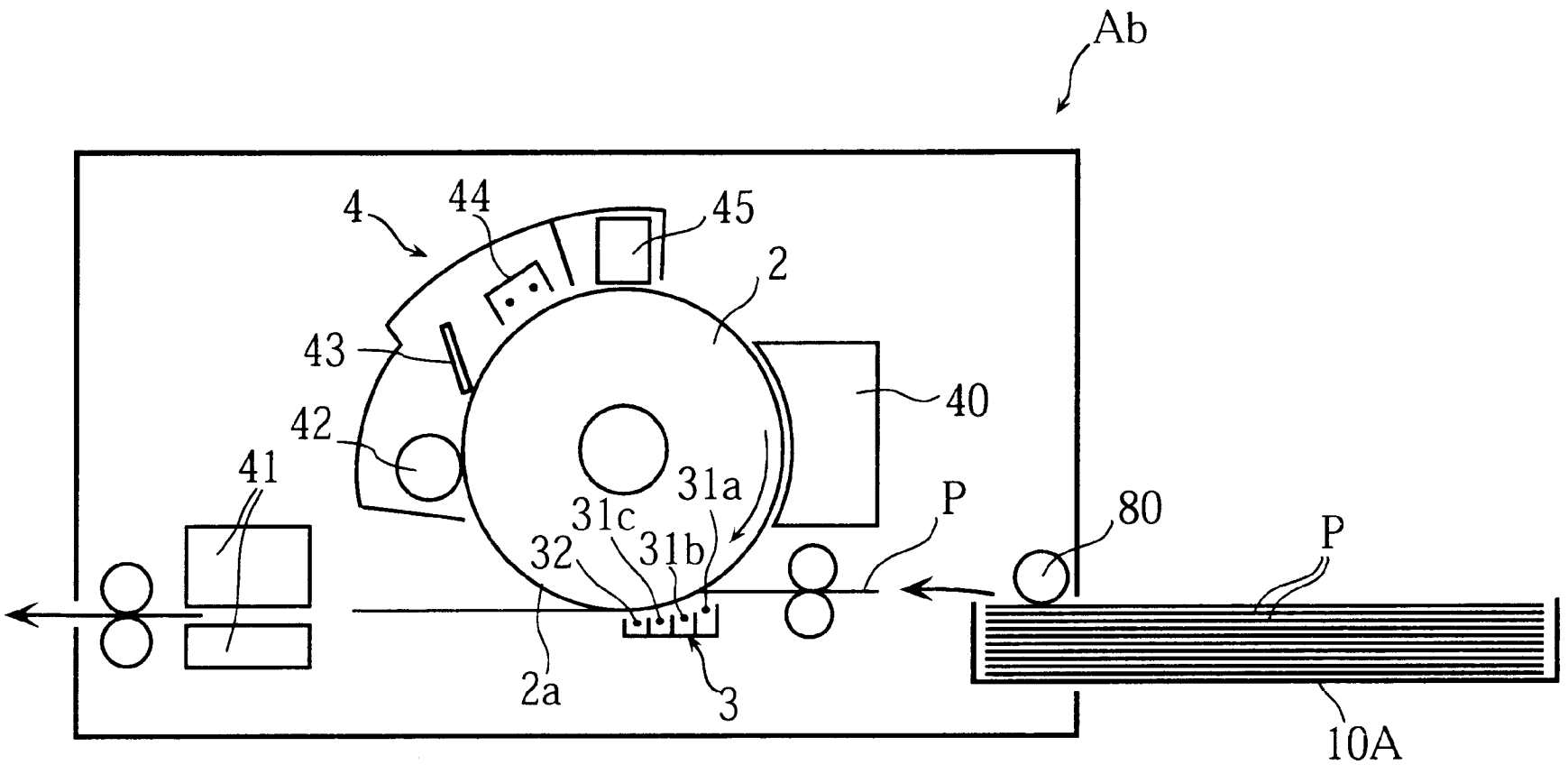
FIG. 10 is a side view showing the outline of a printer according to a third embodiment of the present invention.
Figure 11:
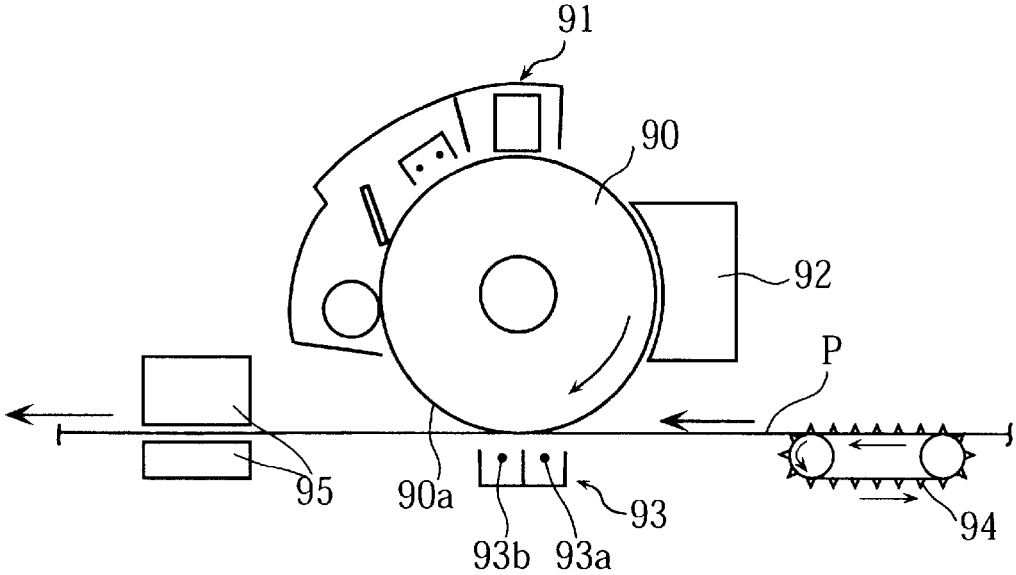
FIG.11 PRIOR ART
FIG. 11 is a side view showing principal parts of a conventional printer.
Figure 12:
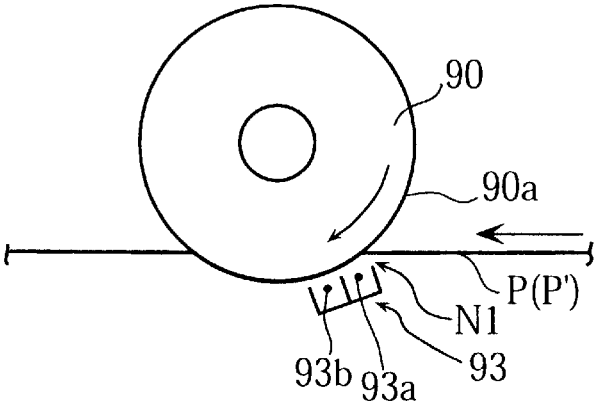
FIG.12 PRIOR ART
FIG. 12 is a side view showing how thin paper is held in contact with the photosensitive drum of FIG. 11.
Figure 13:
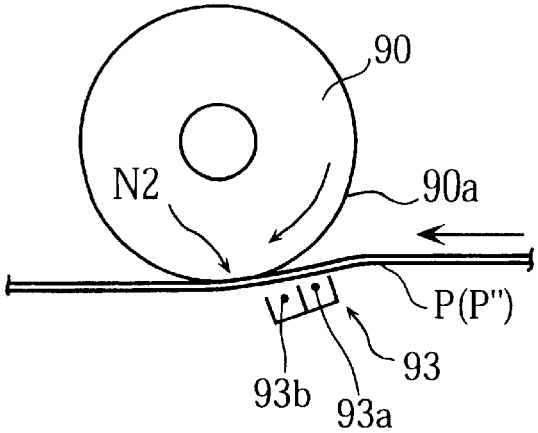
FIG.13 PRIOR ART
FIG. 13 is a side view showing how thick paper is held in contact with the photosensitive drum of FIG. 11.

FIG. 10 shows a printer Ab according to a third embodiment of the present invention, wherein use is made of separate recording paper sheets P. The paper sheets P are supplied, one by one, from a casing 10A by a feed roller 80 and fed between the drum 2 and the transfer charge unit 3. In this respect, the printer Ab differs from the above-described printers A and Aa utilizing continuous perforated paper. However, the principles for transferring toner images from a photosensitive drum to recording paper are the same for the three printers A, Aa and Ab. As seen from this example, the present invention is also applicable to a printer arranged to print on separate recording sheets.

It is clear that the present invention is applicable not only to a printer for performing monochrome printing but also to a printer for performing color printing. According to the present invention, a belt-like member is usable for producing electrostatic latent images in place of a photosensitive drum.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A printer comprising:

a photosensitive member on which a toner image is formed;

image transfer means held in facing relation to the photosensitive member and arranged to conduct a transfer current for transferring the toner image onto a recording medium; and at least one static-eliminating wire for conducting a discharge current for discharging the recording medium, wherein the image transfer means is provided with a plurality of transfer wires spaced from each other in a feeding direction of the recording medium, the transfer current being supplied at least to selected one of the transfer wires in a first mode, the transfer current being supplied at least to another one of the transfer wires in a second mode.

2. The printer according to claim 1, wherein the transfer current is variable.

3. The printer according to claim 1, wherein the discharge current is variable.

4. The printer according to claim 1, further comprising a common casing for fixing the transfer wires and the static-eliminating wire.

5. A printer comprising:

a photosensitive member on which a toner image is formed;

image transfer means held in facing relation to the photosensitive member and arranged to conduct a transfer current for transferring the toner image onto a recording medium;

at least one static-eliminating wire for conducting a discharge current for discharging the recording medium;

a power circuit for supplying the transfer current to the image transfer means;

controlling means for causing the power circuit to selectively supply the transfer current to the image transfer means; and operation means arranged to be operated in a first manner when a thickness of the recording medium is no greater than a predetermined value, while being operated in a second manner when said thickness is greater than the predetermined value;

wherein the image transfer means is provided with a plurality of transfer wires spaced in a feeding direction of the recording medium, the transfer current being supplied at least to selected one of the transfer wires when the operation means is operated in said first manner, the transfer current being supplied at least to another one of the transfer wires when the operation means is operated in said second manner, said another one of the transfer wires being located downstream in the feeding direction from said selected one of the transfer wires.

6. A printer comprising:

a feeding path along which elongated recording medium is fed;

a photosensitive member on which a toner image is formed;

image transfer means held in facing relation to the photosensitive member and arranged to conduct a transfer current for transferring the toner image onto the recording medium;

at least one static-eliminating wire for conducting a discharge current for discharging the recording medium; and controlling means for adjusting the transfer current and the discharge current;

wherein the image transfer means is provided with a plurality of transfer wires spaced along the feeding path, the transfer current being selectively conducted through the transfer wires; and wherein the transfer current and the discharge current are rendered greater for performing automatic-loading of the recording medium than for performing printing on the recording medium.

7. The printer according to claim 6, wherein the transfer wires are moved farther away from the photosensitive member for performing the automatic-loading of the recording medium than for performing the printing on the recording medium.

8. A transfer charger comprising:

a transfer current conductor for conducting a transfer current, the conductor being held in facing relation to a photosensitive member of a printer; and at least one static-eliminating wire for conducting a discharge current, wherein the transfer current conductor is provided with a plurality of transfer wires arranged in parallel, the transfer current being supplied at least to selected one of the transfer wires in a first mode, the transfer current being supplied at least to another one of the transfer wires in a second mode.

* * * * *